US010494875B2

(12) United States Patent
Richert

(10) Patent No.: US 10,494,875 B2
(45) Date of Patent: Dec. 3, 2019

(54) IMPREGNATED DRILL BIT INCLUDING A PLANAR BLADE PROFILE ALONG DRILL BIT FACE

(71) Applicant: Baker Hughes, a GE company, LLC, Houston, TX (US)

(72) Inventor: Volker Richert, Celle/Gross-Hehlen (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 148 days.

(21) Appl. No.: 15/405,848

(22) Filed: Jan. 13, 2017

(65) Prior Publication Data

US 2018/0202235 A1 Jul. 19, 2018

(51) Int. Cl.

| | |
|---|---|
| ***E21B 10/60*** | (2006.01) |
| ***E21B 10/43*** | (2006.01) |
| ***E21B 10/55*** | (2006.01) |
| ***E21B 10/42*** | (2006.01) |
| *E21B 10/54* | (2006.01) |

(52) U.S. Cl.

CPC ..... *E21B 10/602* (2013.01); *E21B 10/42* (2013.01); *E21B 10/43* (2013.01); *E21B 10/55* (2013.01); *E21B 2010/425* (2013.01); *E21B 2010/545* (2013.01)

(58) Field of Classification Search

CPC ..... E21B 10/602; E21B 10/60; E21B 10/605; E21B 10/54; E21B 10/55; E21B 10/43; E21B 2010/545; E21B 2010/425

See application file for complete search history.

(56) References Cited

U.S. PATENT DOCUMENTS 2,371,489 A * 3/1945 Williams, Jr. ..... E21B 10/46 175/434
2,381,415 A * 8/1945 Williams, Jr. ..... E21B 10/46 175/400

(Continued)

FOREIGN PATENT DOCUMENTS

EP 0370717 A1 5/1990
EP 0869256 A2 10/1998

(Continued)

OTHER PUBLICATIONS

European Search Report and Written Opinion for European Application No. 18151522.2, dated Jul. 24, 2018, 11 pages.

*Primary Examiner* — David Carroll
(74) *Attorney, Agent, or Firm* — TraskBritt

(57) ABSTRACT

An impregnated bit for forming a wellbore in an earth formation includes a bit body having a proximal end, a distal end, and a longitudinal axis. A bit face is located at the distal end and extends between the longitudinal axis and a gage. The bit face comprises at least one blade extending radially outward from the longitudinal axis toward the gage and comprising an outer surface to engage formation material. The outer surface of the at least one blade may extend substantially linearly from a distalmost point of the bit face coincident with the longitudinal axis and at an acute angle relative to a line perpendicular to the longitudinal axis of the bit body. The bit face may comprise a first fluid channel extending radially within and across the bit face and a second fluid channel extending radially within and across a portion of the bit face.

20 Claims, 5 Drawing Sheets

(56) References Cited

U.S. PATENT DOCUMENTS

| | | | | |
|---|---|---|---|---|
| 3,583,504 | A | 6/1971 | Aalund | |
| 4,266,621 | A * | 5/1981 | Brock | E21B 7/061 166/55.3 |
| 4,527,643 | A * | 7/1985 | Horton | E21B 10/58 175/420.2 |
| 4,889,017 | A | 12/1989 | Fuller et al. | |
| 6,510,906 | B1 | 1/2003 | Richert et al. | |
| 6,527,065 | B1 * | 3/2003 | Tibbitts | E21B 10/43 175/339 |
| 6,843,333 | B2 | 1/2005 | Richert et al. | |
| 7,278,499 | B2 | 10/2007 | Richert et al. | |
| 7,497,280 | B2 | 3/2009 | Brackin et al. | |
| 7,621,350 | B2 | 11/2009 | Richert | |
| 7,730,976 | B2 | 6/2010 | McClain et al. | |
| 8,191,657 | B2 | 6/2012 | Richert et al. | |
| 8,220,567 | B2 | 7/2012 | Scott et al. | |
| 8,333,814 | B2 | 12/2012 | Brackin et al. | |
| 8,408,338 | B2 | 4/2013 | Richert | |
| 8,757,290 | B2 | 6/2014 | Teodorescu et al. | |
| 9,284,788 | B2 | 3/2016 | Lockwood et al. | |
| 2006/0162967 | A1 | 7/2006 | Brackin et al. | |
| 2008/0029312 | A1 | 2/2008 | Hall et al. | |
| 2008/0135307 | A1 * | 6/2008 | Richert | E21B 10/42 175/393 |
| 2010/0065332 | A1 | 3/2010 | Hall et al. | |
| 2010/0122848 | A1 | 5/2010 | McClain | |
| 2010/0181116 | A1 | 7/2010 | Stauffer | |
| 2010/0219000 | A1 | 9/2010 | Doster | |
| 2011/0061943 | A1 | 3/2011 | Richert | |
| 2015/0060150 | A1 | 3/2015 | Da Silva et al. | |

FOREIGN PATENT DOCUMENTS

| | | | |
|---|---|---|---|
| EP | 1174584 | A2 | 1/2002 |
| FR | 1239437 | A | 8/1960 |
| GB | 1583839 | A | 2/1981 |
| WO | 98/27309 | A1 | 6/1998 |
| WO | 2008/150765 | A1 | 12/2008 |

* cited by examiner

IMPREGNATED DRILL BIT INCLUDING A PLANAR BLADE PROFILE ALONG DRILL BIT FACE

TECHNICAL FIELD

The present invention relates generally to impregnated drag bits for drilling earth formations and, more particularly, to the manner in which the blades and fluid channels on the bit are formed and configured.

BACKGROUND

So-called "impregnated" drag bits are used conventionally for drilling hard and/or abrasive rock formations, such as sandstones. Such conventional impregnated drill bits typically employ a cutting face having blades or inserts comprising superabrasive cutting particles, such as natural or synthetic diamond grit, dispersed within a metal or metal alloy matrix material. As such a bit drills, the matrix material wears away, exposed cutting particles are lost as the surrounding matrix material to which the particles are mechanically and metallurgically bonded is removed, and new cutting particles previously buried within the matrix material become exposed. These diamond particles may be cast integrally with the body of the bit, as in a low-pressure infiltration process to form blades comprising the diamond particles and matrix material, or inserts comprising the diamond particles and matrix material may be preformed separately from the bit body, such as in a hot isostatic press (HIP) sintering process, and the inserts may be attached subsequently to the bit body by brazing. In other processes, such preformed inserts may be placed within a mold in which the bit body is cast using an infiltration process. In such a process, the inserts become bonded to the bit body as the bit body is formed over and around the inserts.

Conventional impregnated bits generally exhibit a poor hydraulics design by employing what is referred to in the industry as a "crow's foot" to distribute drilling fluid across the bit face and providing only minimal flow area. Further, conventional impregnated bits do not drill effectively when the bit encounters softer and less abrasive layers of rock, such as shales. When drilling through shale, or other soft formations, with a conventional impregnated drag bit, the cutting structure tends to quickly clog or "ball up" with formation material, making the drill bit ineffective. The softer formations can also plug up fluid courses formed in the drill bit, causing heat buildup and premature wear of the bit. Therefore, when shale-type formations are encountered, a more aggressive bit is desired to achieve a higher rate of penetration (ROP). It follows, therefore, that selection of a bit for use in a particular drilling operation becomes more complicated when it is expected that formations of more than one type will be encountered during the drilling operation.

BRIEF SUMMARY

In some embodiments of the present disclosure, an impregnated bit for forming a wellbore in an earth formation includes a bit body having a proximal end, a distal end, and a longitudinal axis. A bit face is located at the distal end and extends between the longitudinal axis and a gage. The bit face comprises at least one blade extending radially outward from the longitudinal axis toward the gage and comprising an outer surface to engage formation material. The outer surface of the at least one blade extends substantially linearly from a distalmost point of the bit face coincident with the longitudinal axis and at an acute angle relative to a line perpendicular to the longitudinal axis of the bit body.

In additional embodiments of the present disclosure, an impregnated bit for forming a wellbore in an earth formation includes a bit body having a proximal end, a distal end, and a longitudinal axis. A bit face is located at the distal end and extends between the longitudinal axis and a gage. The bit face comprises at least one blade extending radially outward from the longitudinal axis toward the gage and comprising an outer surface to engage formation material. The bit face further comprises a first fluid channel recessed within the bit face adjacent the at least one blade and extending radially across the bit face from a radially innermost portion proximate to the longitudinal axis to the gage and a second fluid channel recessed within the bit face adjacent the at least one blade and extending radially across a portion of the bit face from a radially innermost portion located further from the longitudinal axis relative to the radially innermost portion of the first fluid channel to the gage. The bottoms of the first fluid channel and the second fluid channel are recessed equidistant from the outer surface of the at least one blade.

In yet further embodiments of the present disclosure, an impregnated bit for forming a wellbore in an earth formation includes a bit body having a bit face extending between a longitudinal axis and a gage. The bit face comprises a plurality of blades extending radially outward from the longitudinal axis and axially along the gage, wherein the plurality of blades comprises a plurality of pairs of blades circumferentially spaced about the longitudinal axis. The bit face further comprises a first fluid channel extending between circumferentially adjacent pairs of blades and radially across the bit face from a radially innermost portion proximate to the longitudinal axis to the gage and a second fluid channel extending between each blade of the pairs of blades and radially across a portion of the bit face from a radially innermost portion located further from the longitudinal axis relative to the radially innermost portion of the first fluid channel to the gage.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not meant to be actual views of any particular drill bit or component thereof, but are merely idealized representations that are employed to describe embodiments of the present disclosure.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the term "and/or" includes any and all combinations of one or more of the associated listed items.

Figure 1:
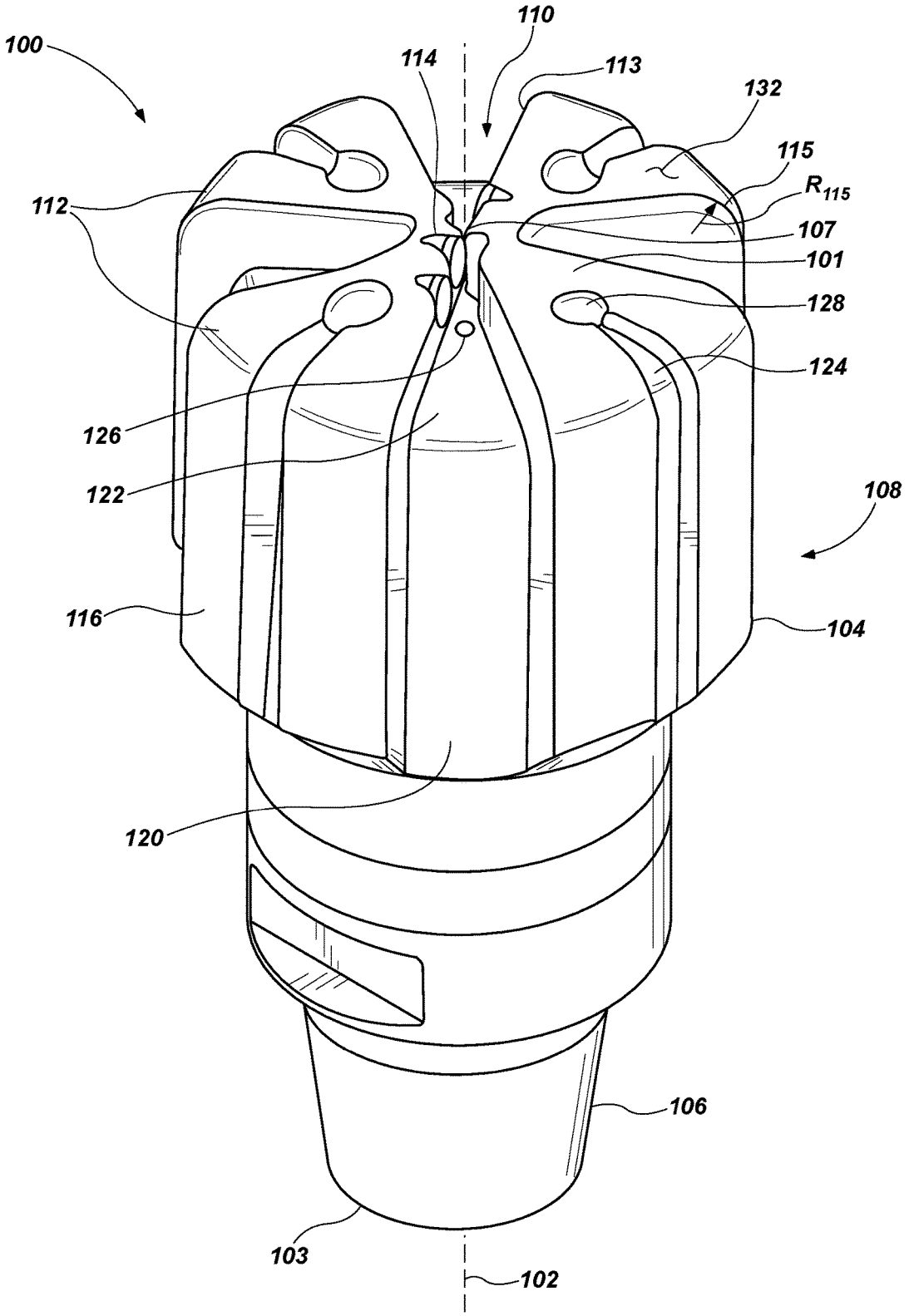
FIG. 1 is a perspective view of a drill bit according to some embodiments of the present disclosure.

FIG. 1 is a perspective view of an impregnated drag bit 100 according to embodiments of the present disclosure. For purposes of description, the bit 100 is inverted from its normal face-down orientation during operation of the bit 100 while forming a wellbore in an earth formation. The bit 100 may have a longitudinal axis 102, conventionally the centerline of a bit body 104 and the axis about which the bit 100 rotates in operation. The bit body 104 may comprise a shank 106 for connection to a drill string (not shown). The shank 106 may be coupled to a crown 108 of the bit 100. In some embodiments, the crown 108 may comprise an impregnated material, which refers to a matrix material having superabrasive particles or material including, but not limited to, natural or synthetic diamond grit dispersed therein. The crown 108 may comprise a bit face 110 extending from the longitudinal axis 102 to a gage 116. The bit face 110 is illustrated in a front view in FIGS. 2A and 2B. As best illustrated in FIG. 1, the bit face 110 may have a shallow conical shape having an apex 107 coincident with the longitudinal axis 102 of the bit 100.

In operation, the bit 100 is extended into the wellbore by a drill string connected to a drilling rig located at a surface of the earth formation in which the wellbore is formed. Thus, the bit 100 is inverted from the view of FIG. 1 in operation such that the bit face 110 engages and cuts formation material within the borehole. In other words, the bit face 110 is located distal from the surface of the earth formation where the drilling rig is located, and the bit face 110 comprises a distal end 101 of the bit 100. A distalmost point of the bit face 110 may be located coincident with the longitudinal axis 102. For example, in embodiments in which the bit face 110 is conical in shape, the distal most point of the bit face 110 may comprise the apex 107 of the bit face 110. The shank 106, which may be connected to a drill string, may be located proximal to the surface of the earth formation comparative to the bit face 110. In other words, the shank 106 comprises a proximal end 103 of the bit 100.

Figure 2A:
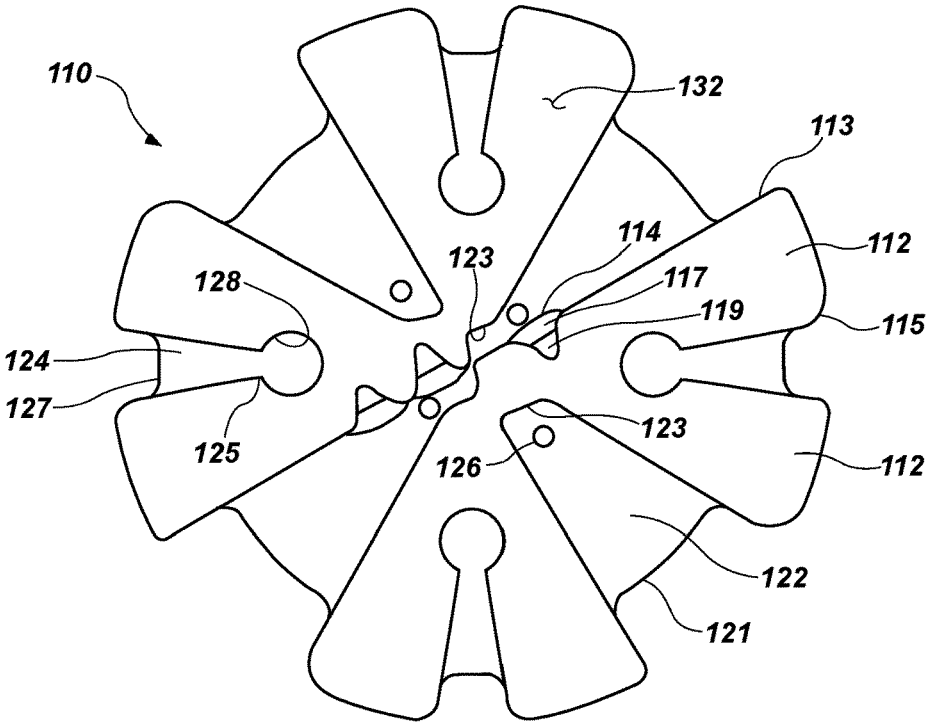
FIGS. 2A and 2B are views of a bit face of the drill bit of FIG. 1 according to some embodiments of the present disclosure.
Figure 2B:
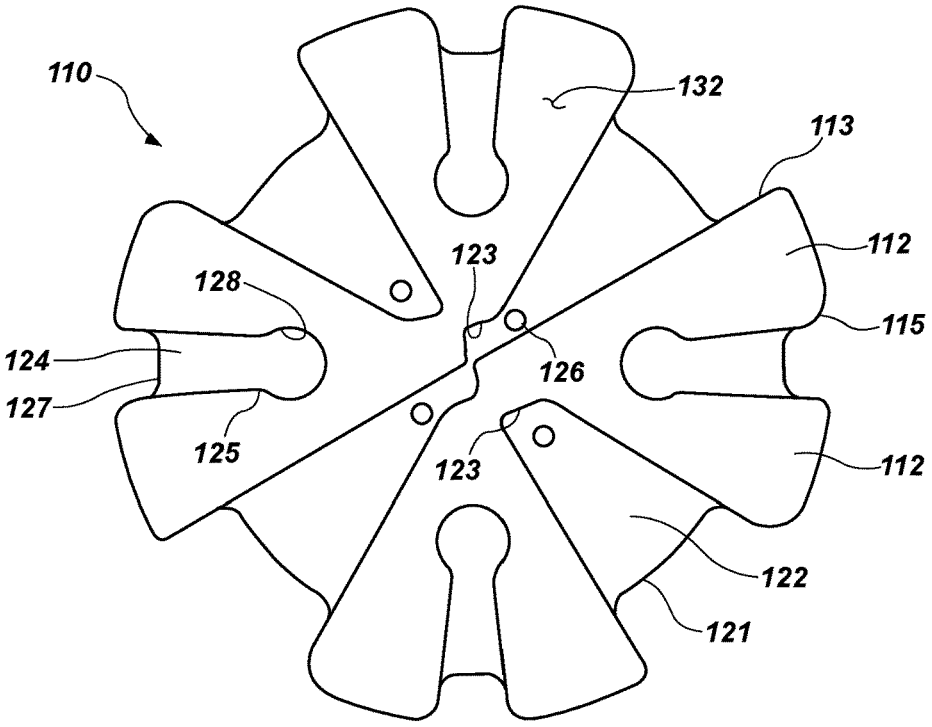

With continued reference to FIGS. 1, 2A, and 2B, the crown 108 may comprise a plurality of blades 112 circumferentially spaced about the longitudinal axis 102 and extending generally radially outward from the longitudinal axis 102 to the gage 116. The blades 112 may extend in a generally linear fashion (as opposed to a spiral or curved fashion) from the longitudinal axis 102 to the gage 116 in some embodiments. The plurality of blades 112 may also extend axially along the gage 116. The gage 116 may comprise a radially outermost surface of the bit 100 surrounding the bit face 110 for engaging a sidewall of the wellbore. In some embodiments, one or more cutting elements 114 may be mounted to at least one blade 112. More particularly, the cutting elements 114 may be mounted on a rotationally leading edge 113 of the at least one blade 112 opposite a rotationally trailing edge 115 of the at least one blade 112. The cutting elements 114 may be located proximate to the longitudinal axis 102 and may be generally oriented to face the direction of rotation of the bit 100 about the longitudinal axis 102.

In some embodiments, the cutting elements 114 may comprise polycrystalline diamond compact (PDC) cutting elements. The polycrystalline diamond cutting elements 114 may each comprise a supporting substrate 119 having a diamond table 117 thereon. The cutting elements 114 may be oriented to remove material from the underlying earth formation by a shearing action as the drill bit 100 is rotated about the longitudinal axis 102 and by contacting the formation material with cutting edges and cutting surfaces of the cutting elements 114. In some embodiments, the cutting elements 114 may comprise PDC cutting elements offered by DiaroTech SA that include a diamond table and an impregnated substrate. The impregnated substrate may comprise a matrix material having a plurality of abrasive particles including, but not limited to, diamond particles dispersed therein. In operation, the impregnated substrate may provide additional cutting action when the diamond table has at least partially worn away. For example, the impregnated substrate may be self-sharpening such that, as the matrix material of the substrate wears away, superabrasive particles disposed and held therein may be shed and fresh, unworn abrasive particles may be exposed. In such embodiments, the useful life of the cutting elements 114 may be extended by providing cutting action by the substrate in addition to the shearing action provided by the diamond table. Nonetheless, it is recognized that any other suitable type of cutting element, including without limitation natural diamonds, may be utilized in embodiments of the present disclosure.

In operation, the bit 100 may be run into a wellbore and "broken-in" or "sharpened" by drilling into an earth formation at a selected weight-on-bit (WOB) as the bit 100 is rotated about the longitudinal axis 102. In the initial stages of penetration of the earth formation, the bit 100 may be run into the wellbore at an increased rate of penetration (ROP) to wear away the matrix material of the bit 100 and expose the abrasive particles disposed therein. The bit 100 may be "sharpened" when the abrasive particles are sufficiently exposed to cut the earth formation. Once the bit 100 is "sharpened," the ROP stabilizes.

In some embodiments, the rotationally trailing edges 115 of the blades 112 may be provided with a large radius of curvature R115 compared to conventional impregnated drill bits. In some embodiments, the rotationally trailing edges 115 may exhibit a radius of curvature R115 greater than 0.1 inch and less than or equal to about 0.5 inch. By virtue of the curved rotationally trailing edge 115, an initial area of an outer surface 132 of the blade 112 that engages and cuts formation material is smaller than the final area of the outer surface 132 of the blade 112 that engages the formation after wear of the bit. As the matrix material of the crown 108 continues to wear away, the area of the outer surface 132 of the blades 112 that engages the formation increases. The blades 112 of the bit 100 may be "broken-in" or "sharpened" when the curved rotationally trailing surface 115 has worn entirely away. When the bit 100 is sharpened the ROP of the bit 100 may stabilize as the bit 100 continues to wear away from contact with the formation material. In view of the foregoing, the bit 100 may wear to a sharpened state at an increased rate over conventional impregnated bits lacking a large radius of curvature along a rotationally trailing edge of the blades thereof.

The crown 108 may also comprise a plurality of fluid channels between and recessed from the blades 112 and extending to junk slots 120 in the gage 116. The plurality of fluid channels may include at least one long channel 122 and at least one short channel 124. As best illustrated in FIGS. 2A and 2B, the long channel 122 may extend radially across the bit face 110 from proximate the longitudinal axis 102 to the gage 116. The long channels 122 may comprise a radially innermost portion 123 located proximate to the longitudinal axis 102. The long channel 122 may extend between and separate circumferentially adjacent blades 112. In some embodiments, the blades 112 of the bit 100 may be formed in pairs of blades 112. In such embodiments, each pair of blades 112 may be separated from a neighboring (e.g., circumferentially adjacent) pair of blades 112 by the long channel 122. Each blade 112 of the pair of blades 112 may be separated by the short channel 124. The short channel 124 may extend partially across the bit face 110 such that the short channel 124 extends radially across a lesser portion of the bit face 110 than the long channel 122. In other words, the short channel 124 may comprise a radially innermost portion 125 located further from the longitudinal axis 102 relative to the radially innermost portion 123 of the long channels 122. The short channel 124 may extend with a blade 112 to form the pair of blades 112.

Each of the plurality of long channels 122 may comprise a nozzle port 126. The nozzle port 126 may be located proximate to or within the radially innermost portion 123 of the long channel 122. In some embodiments, the nozzle port 126 may be located proximate to at least one of the cutting elements 114. Each of the plurality of short channels 124 may also comprise a nozzle port 128. The nozzle ports 126, 128 communicate drilling fluid flow from an interior of the crown 108 and over the bit face 110. Some or all of the nozzle ports 126, 128 may include a nozzle 170 (FIG. 3) disposed therein. The nozzle ports 126 may direct jets or streams of the drilling fluid to clean and cool the cutting elements 114. The nozzle ports 126 and the nozzle ports 128 may also direct jets or streams of the drilling fluid to clean away formation cuttings, worn matrix material, abrasive particles shed from the matrix material, and other debris from between the blades 112.

The bit 100 may comprise a reduced number of blades 112 as compared to conventional impregnated bits according to some embodiments of the present disclosure. For example, the bit 100 may comprise a smaller number of blades 112 than bits offered by Baker Hughes Inc. under the trademark IREV®, which commonly includes at least twelve blades and as many as fifty blades. In some embodiments, the bit 100 may comprise eight blades 112, as illustrated in FIGS. 2A and 2B. In other embodiments, the bit 100 may comprise between six and twelve blades 112. In some embodiments, each pair of blades 112 may be located equidistant from a neighboring pair of blades 112. In such embodiments, the long channels 122 extending between the blades 112 may have a substantially equal width when measured at the same radial distance from the longitudinal axis 102. In other embodiments, the pairs of blades 112 may be unequally distributed on the bit face 110. In such embodiments, the long channels 122 may vary in width about the bit face 110 when measured at the same radial distance from the longitudinal axis 102.

Each of the channels 122, 124 may increase in width as the channels 122, 124 extend radially outward across the bit face 110 such that the channels 122, 124 may be generally wedge-shaped in the view of FIGS. 2A and 2B. The long channel 122 may have a minimum width measured adjacent to the nozzle port 126 located therein and a maximum width measured at a radially outer surface 121 within the long channel 122. By virtue of the reduced number of blades 112, the width of the long channels 122 according to embodiments of the present disclosure may be greater than the width of similar channels formed in conventional impregnated bits and extending between a longitudinal axis and a gage thereof.

Like the long channel 122, the short channel 124 may have a minimum width measured at the radially innermost portion 125 adjacent the nozzle port 128. The short channel 124 may have a maximum width measured adjacent to a radially outer surface 127 within the channel 124. In some embodiments, the width of the short channel 124 may be tailored based on the earth formation in which the bit 100 is intended for use. For example, as illustrated in FIG. 2B, the short channel 124 may have a greater width when the bit 100 is configured to form a wellbore in soft and less abrasive earth formations, such as clay and shale formations. As illustrated in FIG. 2A, the short channel 124 may have a reduced width when the bit 100 is configured to form a wellbore in hard and more abrasive earth formations, such as sandstone. The width of the short channel 124 may be tailored to increase or decrease fluid pressure therein in order to more effectively clean and remove debris between the blades 112 and to generally increase the cutting efficiency of the bit 100. As discussed in further detail with regard to FIGS. 4A and 4B, the depth of the channels 122, 124 may also be tailored.

In some embodiments, the crown 108 may comprise a plurality of short channels 124 each having radially innermost portions 125 located equidistant from the longitudinal axis 102. In other words, the radially innermost portion 125 of each short channel 124 may be located circumferentially about the longitudinal axis 102 at substantially the same radial distance from the longitudinal axis 102. In such embodiments, each short channel 124 may have substantially the same length measured from the radially innermost portion 125 to the gage 116. In other embodiments, the radially innermost portion 125 of at least one short channel 124 may be located at a radial distance from the longitudinal axis 102 different than the radially innermost portion 125 of at least one other short channel 124. In other words, the short channels 124 may vary in length measured from the radially innermost portion 125 to the gage 116.

The openings of the nozzle ports 126, 128 may vary in size and/or shape. In some embodiments, each of the nozzle ports 126, 128 may comprise a round opening flush with or slightly recessed from the bit face 110. The openings may be circular, oval, or the like. In some embodiments, the nozzle ports 128 located in the short channels 124 may be of a larger size than the nozzle ports 126 located in the long channels 122. In other words, a diameter of the nozzle ports 126 may be less than a diameter of the nozzle ports 128. In other embodiments, the nozzle ports 128 located in the short channels 124 be substantially equal in size to the nozzle ports 126 in the long channels 122. The size of the nozzle ports 126, 128 may be varied to increase or decrease the fluid pressure within the respective fluid channels 122, 124.

Figure 3:
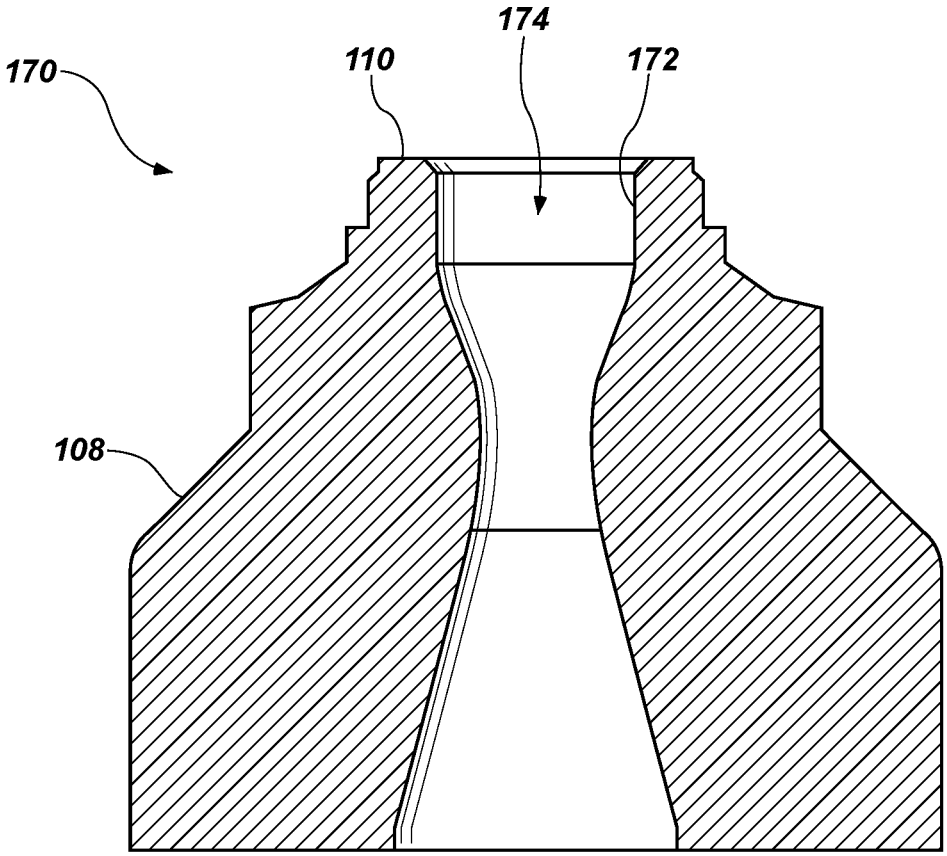
FIG. 3 is a cross-sectional side view of a nozzle according to some embodiments of the present disclosure.

As illustrated in FIG. 3, the nozzle 170 comprises a short tubular member 172 including an aperture 174 extending therethrough and in fluid communication with an interior of the crown 108 for discharging drilling fluid pumped from a formation surface through the drill string and onto the bit face 110 of the bit 100. In some embodiments, the aperture 174 may have a bottleneck-shaped portion as illustrated in FIG. 3. The bottleneck-shaped portion may be provided along the aperture 174 to increase the drilling fluid pressure provided therethrough and further to control the total flow area of nozzle ports 126, 128 providing drilling fluid over the bit face 110 and within the fluid channels 122, 124. In other embodiments, the aperture 174 of the nozzle 170 may have any suitable shape known in the art. Generally, the size and shape of the aperture 174 of the nozzle 170 may be adjusted to control the total flow area of nozzle ports 126, 128 providing fluid over the bit face 110 and within the fluid channels 122, 124.

Figure 4A:
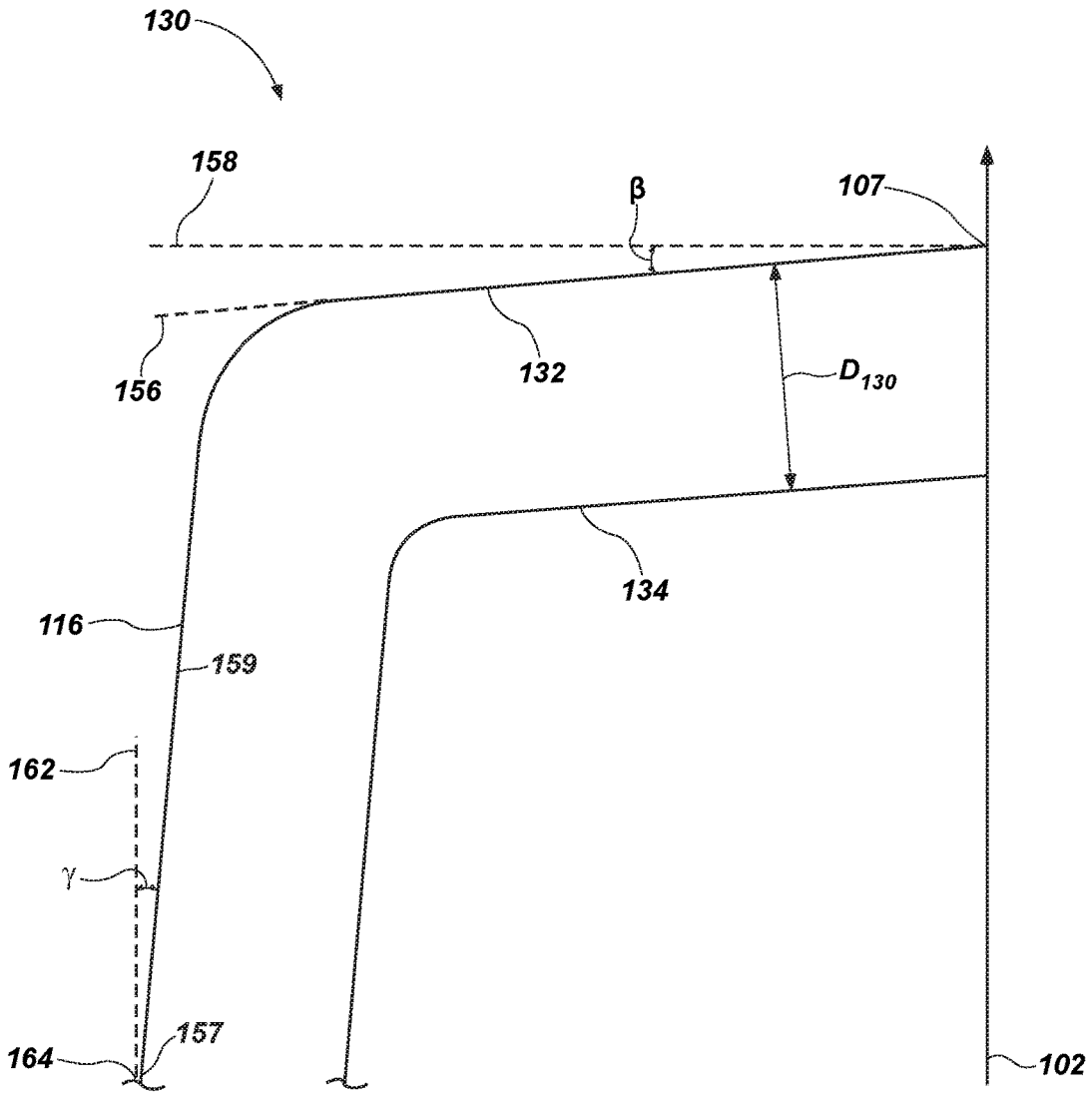
FIG. 4A is diagram of a partial blade profile of the drill bit of FIG. 1 according to some embodiments of the present disclosure.

FIG. 4A illustrates a partial and schematic cross-sectional plane view of the crown 108 of the bit 100. The plane of the cross-section of FIG. 4A includes the longitudinal axis 102 such that the plane extends through the center of the bit 100. More particularly, FIG. 4A illustrates a blade profile 130 of the blades 112 extending between the longitudinal axis 102 and the gage 116. The blade profile 130 illustrates an exposure of an outer surface 132 of the blade 112, which engages the earth formation in operation, relative to an outer surface 134 of at least one of the short channel 124 and the long channel 122. The blade profile 130 further illustrates a depth $D_{130}$ of the fluid channels 122, 124 formed between the blades 112 of the bit 100 relative to the outer surface 132 of the blade 112.

Figure 4B:
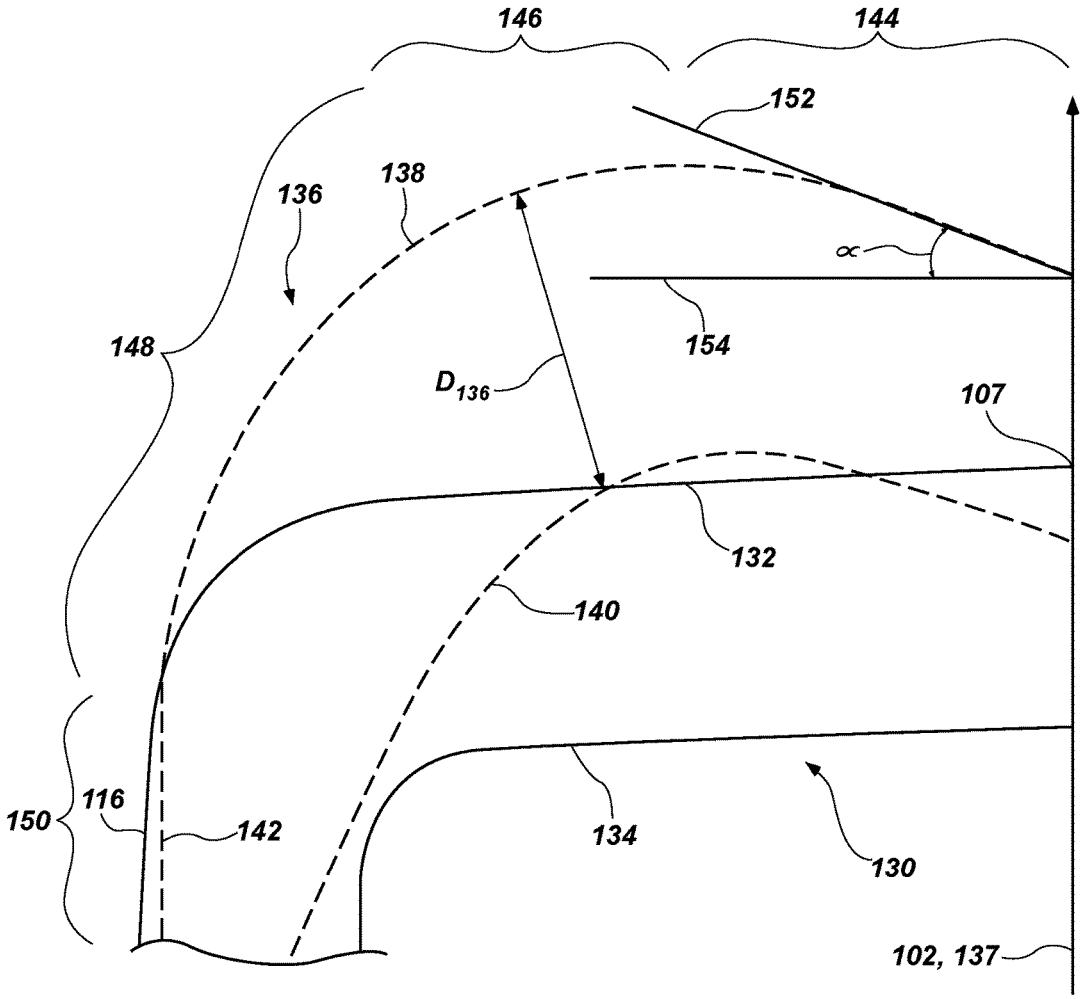
FIG. 4B is a comparative diagram of the partial blade profile of FIG. 4A and a partial blade profile of a conventional drill bit.

FIG. 4B is a comparative plot of the blade profile 130 of the bit 100 to an inverted cone blade profile 136 (shown in dashed lines) of a conventional impregnated drill bit, such as the bit disclosed in U.S. Patent Pub. 2010/0181116, entitled "Impregnated Drill Bit with Diamond Pins," filed Jan. 16, 2009. Like the blade profile 130 according to embodiments of the present disclosure, the blade profile 136 of the conventional bit illustrates an exposure of an outer surface 138 of a blade relative to an outer surface 140 of fluid channels of the conventional bit. The blade profile 136 further illustrates a depth $D_{136}$ of the fluid channels between the blades of a conventional bit relative to the outer surface 138 of the blade. As known in the art, a conventional bit may comprise a plurality of regions between a longitudinal axis 137 and a gage 142 of the bit. These regions include a cone region 144, a nose region 146, a shoulder region 148, and a gage region 150.

The cone region 144 may be located near a centerline of the conventional bit, such as near the longitudinal axis 137. The outer surface 138 of the blade in the cone region 144 may extend in a generally planar manner as indicated by a line 152 tangent to the outer surface 138 of the blade. The tangent line 152 may extend at an angle relative to a line 154 perpendicular to the longitudinal axis 137. The angle $\alpha$ may be measured between the tangent line 152 and line 154 with negative angles being measured in the counterclockwise direction relative to the line 154 and positive angles being measured in the clockwise direction relative to the line 154. In conventional bits, the angle $\alpha$ of the outer surface 138 may extend at a positive acute angle $\alpha$ between about 15° to about 25° and, more particularly, about 20° relative to the line 154. As illustrated in FIG. 4B, the outer surface 138 of blades of the conventional bit may have the shape of an inverted cone in the cone region 144 such that the cone region 144 extends downward in the view of FIG. 4B. In operation, the bit is inverted from its view in FIG. 4B such that the outer surface 138 of the blades in the cone region 144 extends upward and into the crown of the bit away from the earth formation. As a result, the cone region 144 does not experience as much, or as fast, rotational movement relative to the earth formation and, therefore, commonly experiences less wear than the other portions of the blade profile 136.

The nose region 146 includes the most radially distal surfaces on a face of the bit and the uppermost surface in the view of FIG. 4B or, in operation, the lowermost surface on the bit when the bit is inverted. As the lowermost, or axially leading, surface during operation, the nose region 146 experiences greater wear than the cone region 144.

The shoulder region 148 extends between the nose region 146 until the outer surface 138 of the blade is essentially vertical in the gage region 150. The shoulder region 148 may experience a greater amount of and most rapid movement of the bit relative to the earth formation. As a result, the shoulder region 148 experiences much greater wear than the cone region 144. Thus, the shoulder region 148 and/or nose region 146 may experience the greatest wear as compared to any other region of the bit.

The gage region 150 including the gage 142 of the bit also experiences more wear than the cone region 144 because the gage region 150 experiences the most, and most rapid, relative rotational movement with respect to the earth formation. However, due to the substantially vertical slope of the blade in the gage region 150 contacting the wellbore wall, the gage region 150 experiences less wear than the nose region 146 and/or shoulder region 148. In view of the foregoing, the conventional bit experiences an inconsistent rate of wear across the blade profile 136.

As further illustrated in FIG. 4B, the exposure of the blades over the fluid channels of the conventional bit or the depth $D_{136}$ of the fluid channels relative to the blades may vary across and/or within each of the cone region 144, nose region 146, shoulder region 148, and gage region 150. As previously stated, each region of the conventional bit experiences a different degree of wear with the nose region 146 and/or shoulder region 148 experiencing the greatest wear greater contact with the earth formation than other regions of the bit. As the blade wears, the exposure of the blades over the fluid channels is reduced until the outer surface 138 of the blade is coincident with the outer surface 140 of the fluid channel particularly in the nose region 146 and/or shoulder region 148. This extensive wear at first reduces, and then may prevent, drilling fluid from the nozzle ports from flowing across the bit face within the fluid channels therein. As a result, formation cuttings and other abrasive material may accumulate on the bit face and within the fluid channels between the blades. This accumulation of debris reduces drilling efficiency significantly, and may in certain formations such as shales and clays, lead to a phenomenon known as balling, which can reduce the ROP of the bit and result in premature failure of the bit.

As previously described with reference to FIG. 1, the bit face 110 may have a shallow conical shape with the apex 107 of the cone located coincident with the longitudinal axis 102. The outer surface 132 of the blades 112 may at least partially define the bit face 110. Unlike the conventional bit, the bit 100 may lack an inverted cone region, as illustrated in FIGS. 4A and 4B. In some embodiments, the outer surface 132 of the blade 112 extends substantially linearly from the longitudinal axis 102 across a majority of the bit face 110. As illustrated by a line 156 tangent to the outer surface 132 of the blade 112 in FIG. 4A, the blade 112 may extend in a substantially linear manner in a region corresponding to each of the cone region 144 and the nose region 146 of the conventional bit. The line 156 lies in the cross-sectional plane of FIG. 4A, which as previously stated extends through the longitudinal axis 102 or the center of the bit 100.

In some embodiments, the outer surface 132 of the blade 112 may be formed at an acute angle β relative to a line 158 perpendicular to the longitudinal axis 102 of the bit 100 on the bit face 110 of the bit 100. The angle β may be measured between the tangent line 156 and line 158 with negative angles being measured in the counterclockwise direction relative to the line 158 and positive angles being measured in the clockwise directive relative to the line 158. As illustrated in FIGS. 4A and 4B, the outer surface 132 of the blades 112 extends down, or at a negative angle β from, relative to the line 158 and from the longitudinal axis 102. However, in operation, the bit 100 is inverted such that the outer surface 132 of the blades 112 extends upward (e.g., toward the proximal end 103 of the bit 100) and at the angle β from the distalmost point of the bit face 110 (e.g., the apex 107) coincident with the longitudinal axis 102. In some embodiments, the acute angle β may extend in a range from about 0° to about −5° and, more particularly, in a range from about −1° to about −5°. Also unlike the conventional bit, the exposure of the blades 112 over the fluid channels 122, 124 of the bit 100 or the depth $D_{130}$ of the fluid channels 122, 124 relative to the blades 112 may be constant in areas of the bit face 110 corresponding to at least one of the cone region 144, nose region 146, and shoulder region 148 of the conventional bit. In some embodiments, the depth $D_{130}$ of each of the fluid channels 122, 124 relative to the outer surface 132 of the blade 112 may be equal. In other words, the outer surface 134 (e.g., a bottom surface) of the fluid channels 122, 124 may be located equidistant from the outer surface 132 of the blade 112. In other embodiments, the outer surface 134 of either the short channels 124 or the long channels 122 may be recessed at a greater depth from the outer surface 132 of the blade 112 compared to the other channel.

Without being bound by any particular theory, the blade profile 130 may experience substantially even wear over the bit face 110 by virtue of the substantially planar blade profile 130 across the bit face 110. For example, the outer surface 132 of the blades 112 may experience a substantially even amount of movement of the bit 100 relative to the earth formation and a substantially even force from the earth formation may be exerted against the bit face 110 as compared to the conventional bit described above. As a result, the blade profile 130 may experience a more consistent rate of wear across the bit face 110 region. In view of the foregoing, the bit 100 may have a reduced likelihood of balling, a more stable ROP throughout the life of the bit, and an extended bit life relative to conventional bits described above.

FIG. 4A further illustrates an indent angle γ of the gage 116 of the bit 100. The indent angle γ has been exaggerated for the purpose of explanation in FIG. 4A. As known in the prior art and as previously described above, the gage of the conventional bit extends substantially vertically and in parallel to the longitudinal axis 137 of the bit. Unlike the conventional bit, in some embodiments of the present disclosure, the gage 116 of the bit 100 may extend axially and radially inwards from an axially trailing edge 157 to axially leading edge 159, such that the gage 116 may not extend in a parallel direction to the longitudinal axis 102 of the bit 100. In other words, the gage 116 of the bit 100 may extend away from the earth formation during operation thereof.

The indent angle γ may be measured relative to a line 162 tangent to a radially outermost point 164 of the gage 116 and extending parallel to the longitudinal axis 102 of the bit 100. In other words, the indent angle γ may be measured between a surface of the gage 116 along the blade 112 and the tangent line 162 with negative angles being measured in the counterclockwise direction relative to the line 162 and positive angles being measured in the clockwise directive relative to the line 162. In some embodiments, the indent angle γ may be greater than 0° and less than or equal to about 7°. More particularly, the indent angle γ may be greater than 0° and less than or equal to about 3°.

In operation, the bit 100 may be suitable to drill deviated wellbores in earth formations, which include a generally vertical borehole drilled from an earth surface into the formation to culminate in a more horizontal portion or portions within a particular rock formation layer. A curved portion of the wellbore may extend between the vertical portion and horizontal portion thereof. The ability of a drill bit, such as the bit 100, to deviate from the linear path of the vertical portion to the horizontal portion may be defined by its potential radius of curvature. By forming the gage 116 to extend away from the earth formation and radially inward toward the longitudinal axis 102 at the indent angle γ, the amount of contact between the gage 116 and the formation may be reduced, which enables the bit 100 to deviate between the vertical portion and horizontal portion of the wellbore over a shorter distance. In other words, the indent angle γ of the gage 116 may shorten the minimum radius of curvature of the wellbore trajectory that may be drilled by the bit 100. For example, the bit 100 according to some embodiments may deviate (for example) between a vertical portion and horizontal portion of the wellbore over a distance of about 300 feet (about 91 meters) and, more particularly, about 100 feet (about 30.5 meters) or less.

While the disclosed structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A rotary drill bit for forming a wellbore in an earth formation, comprising:

an impregnated bit body comprising diamond grit dispersed in a metal or metal alloy matrix material, the bit body having a proximal end, a distal end, and a central, longitudinal axis; and a bit face located at the distal end and extending between the central, longitudinal axis and a gage, the bit face comprising at least one blade extending radially outward from the central, longitudinal axis toward the gage and comprising an outer surface to engage formation material;

wherein a line tangent to the outer surface of the at least one blade extends along the outer surface of the at least one blade from a distalmost point of the bit face proximate to the central, longitudinal axis to a radially innermost extent of an outer surface portion of a shoulder region of the at least one blade and forms an acute angle relative to a line perpendicular to the central, longitudinal axis of the bit body.

2. The rotary drill bit of claim 1, wherein the acute angle relative to the line perpendicular to the central, longitudinal axis is greater than 0 degrees and less than or equal to 5 degrees.

3. The rotary drill bit of claim 1, wherein the acute angle relative to the line perpendicular to the central, longitudinal axis is greater than or equal to 0.5 degrees and less than or equal to 1.44 degrees.

4. The rotary drill bit of claim 1, further comprising at least one cutting element mounted on the at least one blade proximate to the central, longitudinal axis.

5. The rotary drill bit of claim 4, wherein the at least one cutting element comprises a polycrystalline diamond table mounted to an impregnated substrate, the impregnated substrate comprising a plurality of abrasive particles dispersed in a matrix material.

6. The rotary drill bit of claim 1, wherein the bit body comprises a plurality of blades and wherein the bit face as defined by outer surfaces of the plurality of blades is conical in shape as the blades extend from the central, longitudinal axis to the radially innermost extent of an outer surface portion of the shoulder region, an apex of the conical shape located coincident with the longitudinal axis.

7. The rotary drill bit of claim 1, wherein the at least one blade extends axially along the gage, and wherein the outer surface of the at least one blade along the gage extends radially inward toward the central, longitudinal axis from a trailing edge to a leading edge of the gage.

8. The rotary drill bit of claim 7, wherein the outer surface of the at least one blade extends at an acute angle relative to a line tangent the outer surface of the at least one blade in the gage and extending parallel to the longitudinal axis.

9. The rotary drill bit of claim 8, wherein the acute angle is greater than 0 degrees and less than or equal to 3 degrees.

10. The rotary drill bit of claim 1, further comprising:

a first fluid channel recessed in the bit face adjacent the at least one blade and extending across the bit face from a radially innermost portion proximate to the longitudinal axis to the gage; and a second fluid channel adjacent the at least one blade, recessed in the bit face, isolated from the first fluid channel and extending partially across the bit face to the gage from a radially innermost portion located further from the longitudinal axis relative to the radially innermost portion of the first fluid channel.

11. A rotary drill bit for forming a wellbore in an earth formation, comprising:

an impregnated bit body comprising diamond grit dispersed in a metal or metal alloy matrix material, the bit body having a proximal end, a distal end, and a central, longitudinal axis;

a plurality of blades extending radially outward from the central, longitudinal axis and toward a gage, each blade of the plurality of blades having an outer surface to engage formation material, wherein a bit face defined by the outer surfaces of the plurality of blades is conical in shape, the conical shape extending from the central, longitudinal axis to a radially innermost extent of an outer surface of a shoulder region;

a first fluid channel recessed within the bit face adjacent at least one blade and extending radially across the bit face from a radially innermost portion proximate to the central, longitudinal axis to the gage; and a second fluid channel recessed within the bit face adjacent the at least one blade, the second fluid channel isolated from the first fluid channel and extending radially across a portion of the bit face from a radially innermost portion located further from the longitudinal axis relative to the radially innermost portion of the first fluid channel to the gage;

wherein bottoms of the first fluid channel and the second fluid channel are recessed equidistant from the outer surface of the at least one blade.

12. The rotary drill bit of claim 11, further comprising:

a first nozzle port located proximate the central, longitudinal axis within the first fluid channel; and a second nozzle port located proximate a point intermediate the longitudinal axis and the gage within the second fluid channel.

13. The rotary drill bit of claim 12, wherein a diameter of the second nozzle port is greater than a diameter of the first nozzle port.

14. The rotary drill bit of claim 11, wherein each of the first fluid channel and the second fluid channel increases in width as each of the first fluid channel and the second fluid channel extend radially outward toward the gage.

15. The rotary drill bit of claim 11, wherein the outer surface of the at least one blade of the plurality of blades extends at an acute angle greater than 0 degrees and less than or equal to 5 degrees, the acute angle measured between a line perpendicular to the longitudinal axis of the bit body and a line tangent to the outer surface of the at least one blade.

16. The rotary drill bit of claim 11, wherein at least one blade of the plurality of blades comprises a rotationally trailing edge of the outer surface of the at least one blade exhibiting a radius of curvature greater than 0.1 inch and less than or equal to 0.5 inch.

17. An impregnated bit for forming a wellbore in an earth formation, comprising:

a bit body having a proximal end, a distal end, and a longitudinal axis; and a bit face located at the distal end and extending between the longitudinal axis and a gage, the bit face comprising at least one blade extending radially outward from the longitudinal axis toward the gage and comprising an outer surface to engage formation material;

wherein a line tangent to the outer surface of the at least one blade extends from a distalmost point of the bit face proximate to the longitudinal axis to a shoulder region and forms an acute angle relative to a line perpendicular to the longitudinal axis of the bit body, the acute angle being greater than 0 degrees and less than or equal to 5 degrees.

18. The impregnated bit of claim 17, further comprising:

a first fluid channel recessed in the bit face adjacent the at least one blade and extending across the bit face from a radially innermost portion proximate to the longitudinal axis to the gage; and a second fluid channel adjacent the at least one blade, recessed in the bit face and extending partially across the bit face from a radially innermost portion located further from the longitudinal axis relative to the radially innermost portion of the first fluid channel to the gage.

19. The impregnated bit of claim 18, wherein bottoms of each of the first fluid channel and the second fluid channel are recessed equidistant from the outer surfaces of a plurality of blades across a majority of the bit face.

20. The impregnated bit of claim 18, wherein a width of at least one channel of the first and second fluid channels increases as the at least one channel extends radially outward toward the gage such that the at least one channel is generally wedge-shaped in a bit face view.

* * * * *